US011859483B2

(12) United States Patent
Brooks

(10) Patent No.: US 11,859,483 B2
(45) Date of Patent: Jan. 2, 2024

(54) SELECTIVE OVERBALANCED PERFORATION AND INJECTION

(71) Applicant: Matthew Brooks, Calgary (CA)

(72) Inventor: Matthew Brooks, Calgary (CA)

( * ) Notice: Subject to any disclaimer, the term of this patent is extended or adjusted under 35 U.S.C. 154(b) by 0 days.

(21) Appl. No.: 18/249,936

(22) PCT Filed: Apr. 27, 2022

(86) PCT No.: PCT/IB2022/053928
§ 371 (c)(1),
(2) Date: Apr. 20, 2023

(87) PCT Pub. No.: WO2022/229887
PCT Pub. Date: Nov. 3, 2022

(65) Prior Publication Data

US 2023/0313656 A1 Oct. 5, 2023

Related U.S. Application Data

(60) Provisional application No. 63/201,479, filed on Apr. 30, 2021.

(51) Int. Cl.
*E21B 43/26* (2006.01)

(52) U.S. Cl.
CPC ..... *E21B 43/261* (2013.01)

(58) Field of Classification Search
CPC ..... E21B 43/261; C09K 8/34
(Continued)

(56) References Cited

U.S. PATENT DOCUMENTS 5,704,426 A 1/1998 Rytlewski et al.
6,491,098 B1 12/2002 Dallas
(Continued)

FOREIGN PATENT DOCUMENTS

CA 2325120 A1 5/2002
CN 112127837 A 12/2020
(Continued)

OTHER PUBLICATIONS

International Search Report and Written Opinion of the International Searching Authority in related International Application No. PCT/IB2022/053928, dated Jul. 29, 2022, 10 pages.

*Primary Examiner* — William D Hutton, Jr.
*Assistant Examiner* — Ashish K Varma
(74) *Attorney, Agent, or Firm* — Craige Thompson; Thompson Patent Law; Timothy D. Snowden

(57) ABSTRACT

Apparatus and associated methods relate to pre-completion skin repair of releasably isolated wellbore perforation clusters. In an illustrative example, a completion method includes dividing a target portion of a wellbore casing into N distinct portions. For each distinct portion, a wireline bottom hole assembly (BHA) may be positioned, for example, in a most downstream unperforated portion. The selected portion may, for example, be releasably fluidly isolated from downstream perforation clusters, and a new perforation cluster may be generated. A non-particulate skin-repairing fluid may, for example, be pumped from uphole until a breakdown pressure of a geological formation surrounding the wellbore is exceeded. The BHA may, for example, be operated to reestablish fluid communication before moving to a next portion. After repeating the process in the N distinct portions, for example, the BHA may be removed prior to final wellbore completion. Various embodiments may advantageously improve wellbore completion efficiency.

20 Claims, 9 Drawing Sheets

(58) Field of Classification Search
USPC ..... 166/308.1
See application file for complete search history.

(56) References Cited

U.S. PATENT DOCUMENTS

| | | | | |
|---|---|---|---|---|
| 6,568,472 | B1 * | 5/2003 | Gano | E21B 43/105 166/207 |
| 9,506,333 | B2 | 11/2016 | Castillo et al. | |
| 2002/0007949 | A1 * | 1/2002 | Tolman | E21B 33/138 166/305.1 |
| 2011/0155375 | A1 * | 6/2011 | Griffith | E21B 43/1195 166/298 |
| 2015/0176384 | A1 | 6/2015 | Castillo et al. | |
| 2015/0285052 | A1 | 10/2015 | Tolman et al. | |
| 2018/0274346 | A1 * | 9/2018 | Modeland | E21B 43/116 |
| 2019/0093460 | A1 | 3/2019 | Quintero et al. | |
| 2020/0300072 | A1 * | 9/2020 | Snider | E21B 43/26 |
| 2020/0318455 | A1 | 10/2020 | Jones | |

FOREIGN PATENT DOCUMENTS

| | | | |
|---|---|---|---|
| EP | 0796980 | A3 | 12/1998 |
| EP | 0796980 | B1 | 2/2004 |
| WO | 2022229887 | A1 | 11/2022 |

* cited by examiner

SELECTIVE OVERBALANCED PERFORATION AND INJECTION

CROSS-REFERENCE TO RELATED APPLICATIONS

This is a continuation application under 35 U.S.C. 371 of and claims the benefit of PCT/IB2022/053928, titled "Selective overbalance perforation and injection," filed by Mathew Brooks, on Apr. 4, 2022 which application claims the benefit of U.S. Provisional Application Ser. No. 63/201,479, titled "Selective Overbalanced Perforation and Injection," filed by Matthew Brooks, on Apr. 30, 2021.

This application incorporates the entire contents of the foregoing application(s) herein by reference.

TECHNICAL FIELD

Various embodiments relate generally to method and systems to prepare a wellbore for hydraulic fracturing.

BACKGROUND

Hydraulic fracturing is an oil and gas well development process that may involve, for example, injecting water, sand, and/or chemicals under high pressure into a bedrock formation via an oil and/or gas well. In some examples, the hydraulic fracturing process may be used to create new fractures in the rock and increase the size, extent, and connectivity of existing fractures. Hydraulic fracturing is a well-stimulation technique which may be used, for example, in low-permeability rocks (e.g., tight sandstone, shale, and/or some coal beds, etc.) to increase oil and/or gas flow to a well from petroleum-bearing rock formations. A similar technique may, for example, be used to create improved permeability in underground geothermal reservoirs.

Horizontal drilling is the process of drilling a well from the surface to a subsurface location just above the target oil or gas reservoir called the "kickoff point", then deviating the well bore from the vertical plane around a curve to intersect the reservoir at the "entry point" with a near-horizontal inclination, while remaining within the reservoir until the desired bottom hole location is reached.

A horizontal well may, for example, cost 300 percent more to drill and complete for production than a vertical well directed to the same target horizon. Due to its higher cost, horizontal drilling may be restricted to situations where vertical wells would not be as financially successful. When low matrix permeability exists in the reservoir rock (e.g., especially in the horizontal plane), and/or when coning of gas or water can be expected to interfere with full recovery, horizontal drilling may become a financially viable or even preferred option (e.g., producing 2.5 to 7 times the rate and reserves of vertical wells). The higher production rate translates financially to a higher rate of return on investment for the horizontal project than may be achieved by a vertical project in such situations.

SUMMARY

Apparatus and associated methods relate to pre-completion skin repair of releasably isolated wellbore perforation clusters. In an illustrative example, a completion method includes dividing a target portion of a wellbore casing into N distinct portions. For each distinct portion, a wireline bottom hole assembly (BHA) may be positioned, for example, in a most downstream unperforated portion. The selected portion may, for example, be releasably fluidly isolated from downstream perforation clusters, and a new perforation cluster may be generated. A non-particulate skin-repairing fluid may, for example, be pumped from uphole until a breakdown pressure of a geological formation surrounding the wellbore is exceeded. The BHA may, for example, be operated to reestablish fluid communication before moving to a next portion. After repeating the process in the N distinct portions, for example, the BHA may be removed prior to final wellbore completion. Various embodiments may advantageously improve wellbore completion efficiency.

Various embodiments may achieve one or more advantages. For example, some embodiments may advantageously increase fluid communication between a wellbore and surrounding geological formations. For example, some embodiments may advantageously control a fracture pressure to be exceeded at the instant of creating the access to a reservoir. For example, some embodiments may advantageously provide selective injection into newly created clusters to pump stimulation fluid without pumping into earlier created clusters. For example, some embodiments may reduce environmental impact by reducing a pumping pressure of a fracture stimulation treatment. Various embodiments may advantageously increase a percentage of perforations providing fluid communication between the wellbore and surrounding geological formations compared to initial stimulation of multiple perforation at one time. Various embodiments may advantageously reduce and/or eliminate costs of rework and/or remediation.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, a selective overbalanced perforation and injection system for wellbore completion is introduced with reference to FIGS. 1A-2. Second, that introduction leads into a description with reference to FIGS. 3A-3F of some exemplary methods of selective clusters perforation. Third, with reference to FIG. 4, an exemplary method is described in application to exemplary selective overbalanced perforation and injection. Fourth, with reference to FIGS. 5-7, the discussion turns to exemplary embodiments that illustrate a pressure isolation device. Fifth, this disclosure turns to a discussion of breakdown pressure in wellbore completion with reference to FIG. 8. Finally, the document discusses further embodiments, exemplary applications and aspects relating to selective overbalanced perforation and injection.

Figure 1A:
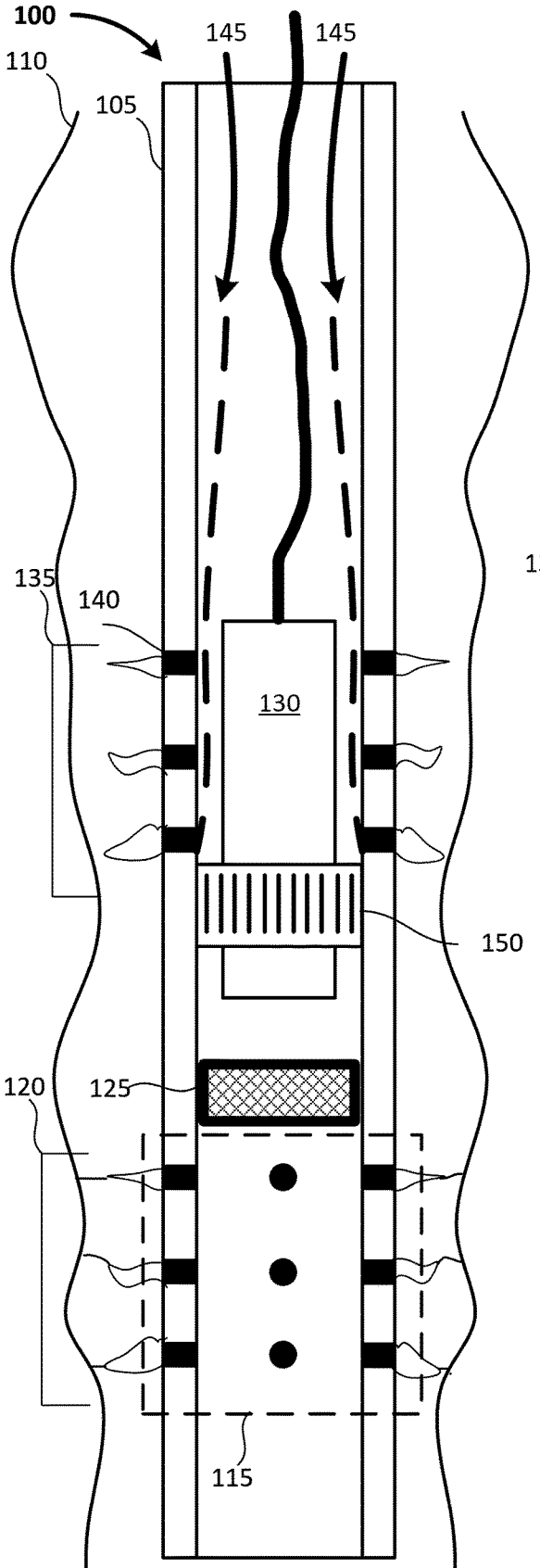
FIG. 1A and FIG. 1B depict an exemplary selective overbalanced perforation and injection (SOPI) system in an illustrative use-case scenario.
Figure 1B:
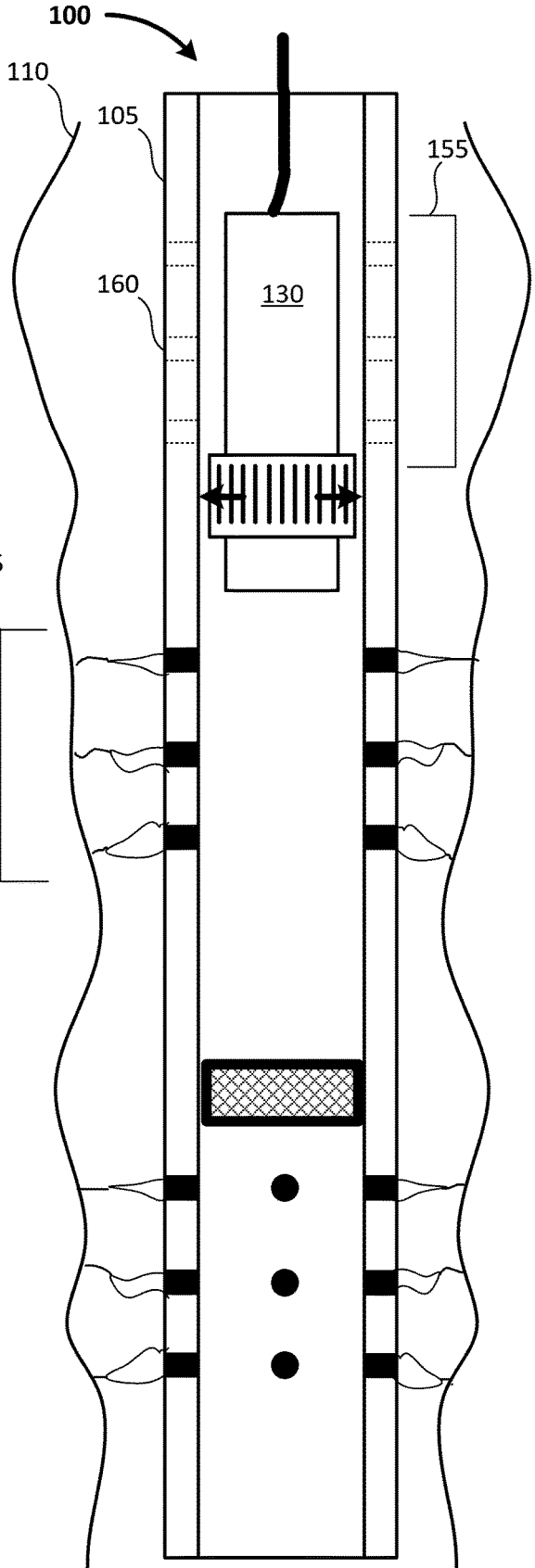

FIG. 1A and FIG. 1B depicts an exemplary selective overbalanced perforation and injection (SOPI) system 100 in an illustrative use-case scenario. In this illustrative example, a wellbore casing 105 (e.g., casing an oil well) is disposed in a geological formation 110 (e.g., at least partially in oil bearing strata). As shown in FIG. 1A, a previous perforation operation (e.g., using a perforation gun) has been performed to form completed perforations 115. In the depicted example, the completed perforations 115 have been stimulated to form a stimulated region 120 in the geological formation 110. A frac plug 125, in this example, was set in the wellbore casing 105 to isolate the completed perforations 115 with upstream of the wellbore casing 105. As an illustrative example, the completed perforations 115 may have been a last cluster of perforations in a previously fractured stage. The previously fractured stage, as depicted is fluidly isolated by the frac plug 125 (e.g., carried and set using a bottom hole assembly) before beginning a next stage.

The SOPI system 100 includes an overbalancing bottomhole assembly (OBBHA) 130. As shown in FIG. 1A, the OBBHA 130 is positioned at a target perforation portion 135 of the wellbore casing 105. As depicted, the OBBHA 130 generates (e.g., detonates, 'shoots open') a plurality of new perforations 140 at the target perforation portion 135. In some examples, a pressured hydraulic fluid 145 is applied after the new perforations 140. For example, the pressured hydraulic fluid 145 may be applied to perform a skin repair operation for the new perforations 140. In some implementations, the pressured hydraulic fluid 145 may be a non-particulate fluid. In some examples, the pressured hydraulic fluid 145 may be configured to have a skin-repairing effect for the newly formed perforations 140.

In this example, the OBBHA 130 includes a pressure isolation device (PID) 150. In some implementations, the PID 150 may be activated to isolate the new perforations 140 with other perforations downstream (e.g., at least partially stimulated perforations, such as having reached breakdown pressure and/or having performed skin repair operations but before final completion such as fracturing) such that the pressured hydraulic fluid 145 is not in fluid communication with the prior perforations 115. In some implementations, a completion of skin repair corresponding to the new perforations 140 may be determined by the pressure hydraulic fluid 145 reaching a geological breakdown pressure of the material surrounding the new perforations 140. For example, the pressured hydraulic fluid 145 may increase in flow rate to increase pressure to stimulate the new perforations 140. In some examples, after the geographical breakdown pressure is reached, a pressure of the pressured hydraulic fluid 145 may drop despite increase in flow rate.

After target skin repair operations of the new perforations 140 are completed by the pressured hydraulic fluid 145, as shown in FIG. 1B, the OBBHA 130 may be moved to another portion 155 upstream of the wellbore casing 105 to form a second set of new perforations 160. In some implementations, the OBBHA 130 may repeat this process until each distinct isolatable portion of perforations in a selected portion in the wellbore casing 105 has had target skin repair operations completed (e.g., breakdown pressure individually reached for each isolatable portion). in some embodiments, for example, the OBBHA 130 may be removed from the wellbore before final completion of the stage (e.g., including the multiple perforation clusters) as a group (e.g., all perforation clusters above the frac plug 125).

For example, the OBBHA 130 may be removed before fracturing fluid is pumped into the wellbore. Accordingly, the SOPI system may advantageously avoid damages of the OBBHA 130 by sand, stone, or other particles that may be used in the fracturing fluid. Such embodiments may, for example, advantageously prevent seizing of the OBBHA 130 in the wellbore due to sand-locking (accumulation of particulates on uphole surfaces of the OBBHA 130 which 'jam' the OBBHA 130 in the wellbore casing 105 when trying to withdraw the OBBHA 130). Therefore, such embodiments may advantageously reduce cost of recovering the OBBHA 130 and/or clearing obstruction of the wellbore casing 105.

In some implementations, to complete and stimulate a target portion of a wellbore using the SOPI system 100 within the wellbore casing 105, the target portion may be divided into N distinct portions along a length of the wellbore casing 105. For each of the N distinct portions, for example, starting from the most downhole portion of the target portion, the OBBHA 130 may releasably fluidly isolate a currently operating portion from downstream such that the currently operating portion is fluidly isolated from substantially all downstream perforation clusters. Next, the OBBHA 130 may, for example, generate a cluster of perforations at the fluidly isolated portion. For example, the OBBHA 130 may include a perforation gun to shoot open the cluster of perforations at the fluidly isolated portion. After the cluster of perforations are formed, for example, a non-particulate skin-repairing fluid may be pumped from uphole at a pressure such that a breakdown pressure of a geological formation surrounding the casing at the plurality of perforations is exceeded. In some examples, once the breakdown pressure is exceeded, the OBBHA 130 may reestablish fluid communication between the currently operating portion and downstream or the wellbore casing 105. After clusters of perforations have been formed at substantially all N distinctive portion, for example, the OBBHA 130 may be removed from the wellbore casing. In some implementations, completion operations may then be performed to complete openings of the geological formations through the perforations.

Figure 2:
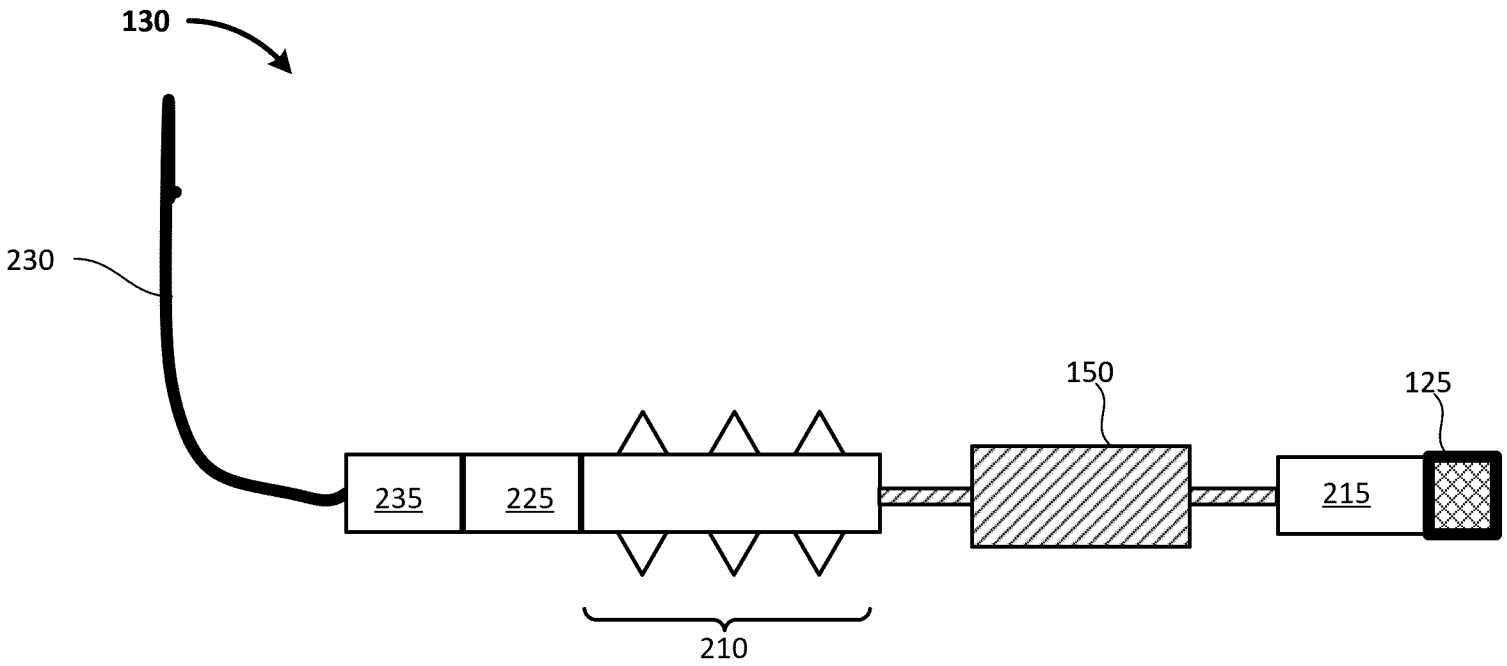
FIG. 2 is a block diagram of an exemplary overbalancing bottomhole assembly (OBBHA) using for the SOPI system described in FIGS. 1A-1B.

FIG. 2 is a block diagram of an exemplary overbalancing bottomhole assembly (OBBHA) 130 using for the SOPI system 100 described in FIG. 1. The OBBHA 130 is provided with the PID 150. In the depicted example, the PID 150 is disposed between a series of perforation guns 210 and a frac plug setting tool 215. As depicted, the frac plug setting tool 215 is coupled to the frac plug 125. The frac plug 125 may, for example, be set in a wellbore casing to isolate a downstream section from an upstream section of the wellbore casing for perforation and/or injection.

Each perforation gun 210 may, for example, have one or more (explosive) charges configured to be detonated by an activation signal. Each charge may, for example, be configured to exit the perforation gun 210 substantially radially and to pierce a wellbore casing, cement, surrounding geological formations, or some combination thereof. Accordingly, fluid communication may be advantageously provided between (fluid-bearing) geological formations and the wellbore.

As depicted, the OBBHA 130 is further provided with depth correlation tool(s) 225. The depth correlation tool(s) 225 may, for example, be configured to determine a position of the OBBHA 130 in the wellbore. In some examples, one or more operations of one or more components of the OBBHA 130 may be initialized at one or more (predetermined) depths based on a depth determined by the depth correlation tool(s) 225.

The OBBHA 130 is provided with a cable 230. The cable 230 is coupled to the OBBHA 130 by a cable connection 235. The cable connection 235 may, for example, also function as an emergency release (E-release) coupler. The cable 230 may, by way of example and not limitation, provide operating power, (electromagnetic) communication to and/or from at least one component of the OBBHA 130 and an operator(s) (e.g., at ground level), mechanical support and/or control, or some combination thereof.

In some implementations, the perforation gun 210 alone may, for example, not sufficiently penetrate surrounding geological formations to provide fluid access between the wellbore and target geological formation (e.g., petroleum bearing formations). In some implementations, to stimulate the perforated holes generated by the perforation gun 210, access-enhancing fluids (e.g., water, acids, solvents, gasses, hydrocarbons) may be pumped into the wellbore casing 105 to pressurize the wellbore.

In some implementations, a number of perforations to be exposed for pressurization at a time may be selected. Exposing a large number of perforations to pressurization of the wellbore may, for example, allow only some of the perforations to receive a disproportionate effect (e.g., enlarging the perforation in the casing and/or cement and/or a corresponding channel in the geological formation). Accordingly, exposing a large number of perforations and/or too many clusters of perforations to pressure simultaneously may have little to no effect on stimulating (e.g., inducing fluid communication through) some or most of the perforations. On the other hand, for example, exposing a small number of perforations may increase a success rate of the stimulating effect. However, the time used for exposing a small number of perforations at a time may significantly increase time and cost for fracturing and/or perforating a same length of the wellbore.

In various embodiments the PID 150 may be selectively activated to fluidly isolate a previous perforation(s) from a target perforation (cluster). Accordingly, the target perforation(s) may be selectively overbalanced (e.g., pressurized over the pressure in a subterrain hydrocarbon bearing rock's pressure) or underbalanced (e.g., pressurized under the pressure in the subterrain hydrocarbon bearing rock's pressure). The target perforation(s) may, therefore, be precisely targeted to ensure the pressurization and/or access fluid may reach target perforation(s) and not be diverted into open perforation(s) below. Accordingly, the SOPI may advantageously efficiently stimulate each new cluster of perforations before creating a subsequent cluster. Various embodiments may advantageously allow a higher percentage (e.g., substantially all) perforation clusters shot to be stimulated to effectively provide fluid communication between the corresponding geological formation(s) and the wellbore, as compared to shooting multiple (e.g., all) perforation clusters before pressurization. In some implementations, the SOPI system may advantageously reduce and/or eliminate costs of rework and/or remediation (e.g., which may be $10,000/hour or more). In various embodiments the perf-cluster (pre-) stimulation (e.g., skin repair, partial completion) may be advantageously performed, for example, without removing the OBBHA 130. Accordingly, each cluster of perforations may, for example, be individually (e.g., per cluster) at least partially stimulated in rapid succession by selective fluid and/or pressure isolation of each new cluster from previously formed perforations by the PID 150.

Figure 3A:
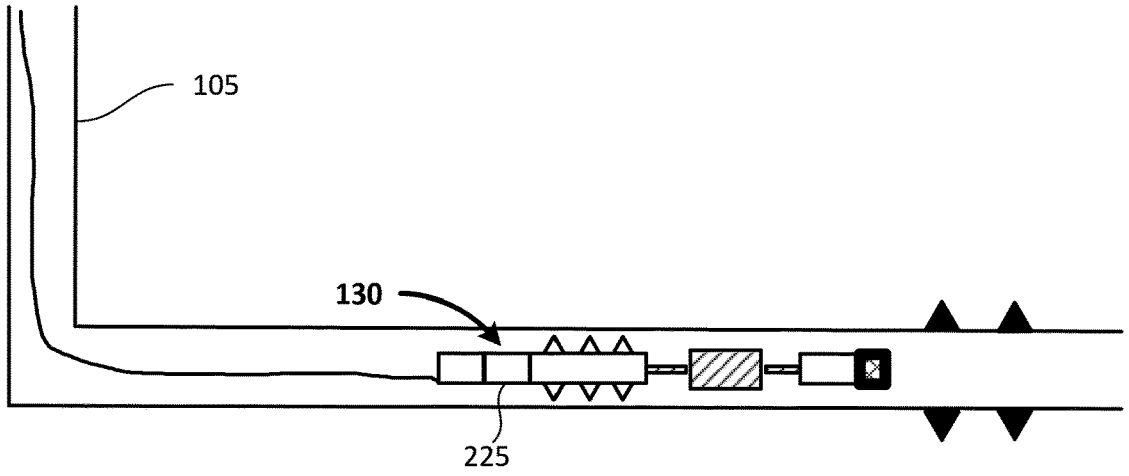
FIG. 3A, FIG. 3B, FIG. 3C, FIG. 3D, FIG. 3E, and FIG. 3F depict the OBBHA of FIG. 2 employed for SOPI in an illustrative wellbore casing.

FIG. 3A, FIG. 3B, FIG. 3C, FIG. 3D, FIG. 3E, and FIG. 3F depict the OBBHA of FIG. 2 employed for SOPI in an illustrative wellbore casing. As depicted, the wellbore casing 105 may, for example, be a horizontal well (e.g., oil well, gas well). The well may, for example, be placed in a shale formation(s). As depicted in FIG. 3A, the OBBHA 130 is disposed within the wellbore casing 105. The OBBHA 130 may, by way of example and not limitation, be hydraulically pumped down into the wellbore casing 105. In various embodiments, the OBBHA 130 may, by way of example and not limitation, be guided into the wellbore casing 105 by a pipe system (e.g., in addition to or in place of the cable 230). In some implementations, the OBBHA 130 may be positioned at a current position based on a depth guidance provided by the depth correlation tool(s) 225.

Figure 3B:
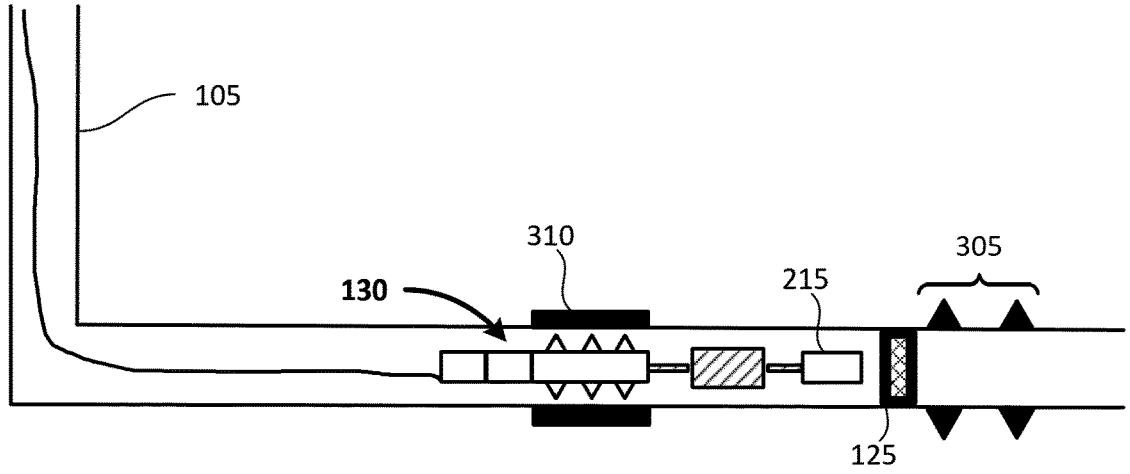
Figure 3C:
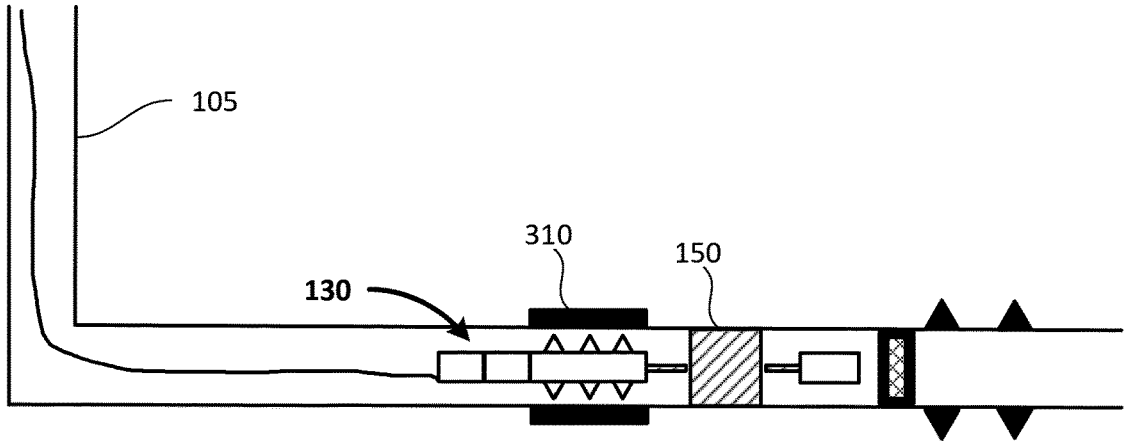

As shown in FIG. 3B, the wellbore casing 105 include a series of previous perforation clusters 305. For example, the perforation clusters 305 may be formed through previously completed perforation and stimulation operations. In this example, the frac plug setting tool 215 set the frac plug 125 to separate the previous batch of perforation clusters 305 from a current batch of perforation clusters to be created. In some examples, the OBBHA 130 may be pulled upstream to a first selected portion 310 for generating the first cluster of perforation. As shown in FIG. 3C, the OBBHA 130 is positioned in the wellbore casing 105 position such that the PID 150 proximally downstream of the first selected portion 310 to be created. In this example, the PID 150 is activated to fully or at least partially isolate a fluid communication between the first selected portion and downstream. In some implementations, the wellbore is pressured up by pumps on surface at this step.

Figure 3D:
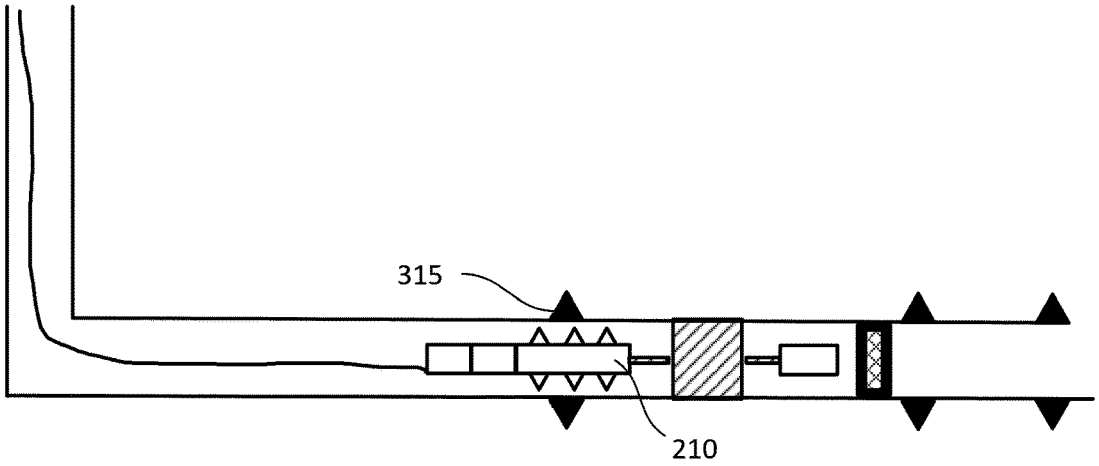

As depicted in FIG. 3D, a first cluster of perforations 315 have been formed in the wellbore casing 105 by the perforation gun 210. In some implementations, when the first cluster 315 is perforated, stimulation fluid (e.g., acid, other fluid) may subsequently be pumped into the cluster. In some examples, the pumping fluid may provide diagnostic functions. In some implementations, by selectively isolating clusters to be injected, diagnostic pumping tests may be performed. Some examples of diagnostic pumping test may include step-up rate tests, step-down pump rate tests, and Diagnostic Fracture Injection Tests (DFIT). In some implementations, the OBBHA 130 may be used to perform real-time diagnostics to determine whether more perforations are needed in the current cluster, for example.

Figure 3E:
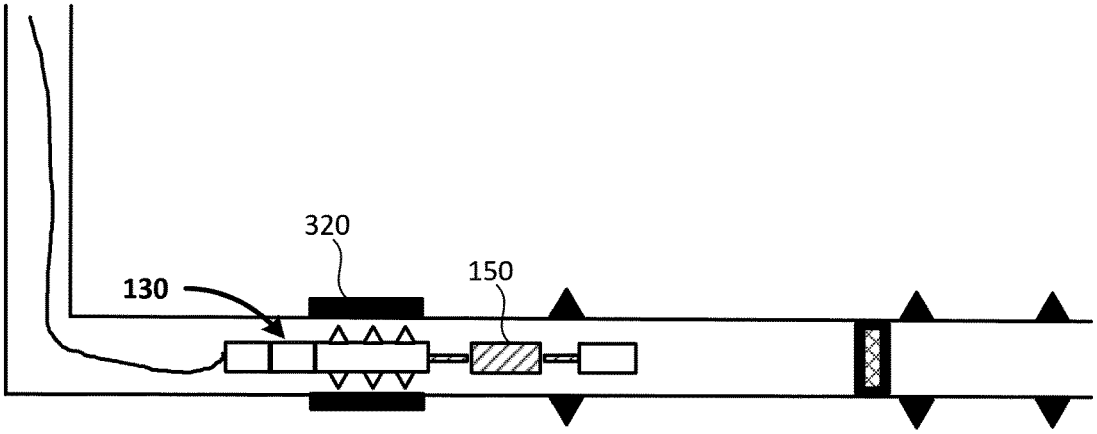
Figure 3F:
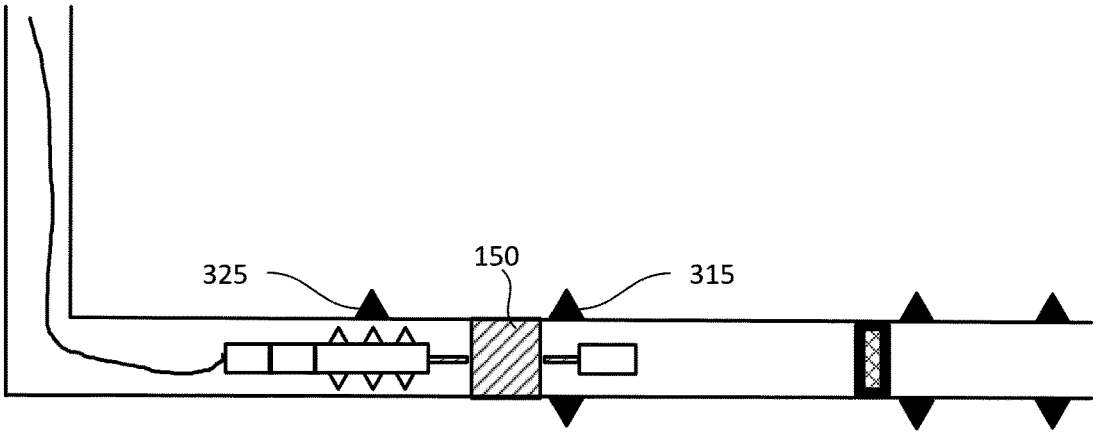

After the first cluster 315 is completely perforated, the PID 150 is deactivated and the OBBHA 130 is moved to a second selective position 320 as shown in FIG. 3E. The PID 150 is then activated to seal against the wellbore casing 105, as shown in FIG. 3F, and a second perforation cluster 325 is formed. Accordingly, the PID 150 fluidly isolates the first perforation cluster 315 from the second perforation cluster 325. For example, the second perforation cluster 325 may be selectively pressured (e.g., overbalanced) before and/or during and/or after shooting the perforation cluster. In some implementations, the selective pressure may be provided external to the OBBHA 130 from the surface. In some examples, the stimulation fluid may be pumped into the wellbore casing 105 to selectively stimulate only the second perforation cluster 325 before further perforation clusters are formed. Accordingly, the second perforation cluster 325 may be advantageously selectively targeted for stimulation to provide a desired level of fluid communication between the inside of the casing and the surrounding geological formation(s).

In some implementations, the above process FIGS. 3A-3F may be repeated to create the desired quantity of clusters within the target portion of the wellbore casing 105. After the desired quantity of clusters is created, for example, the OBBHA 130 may be removed from the wellbore casing. For example, the wellbore casing is then ready to be hydraulically fracture stimulated. In some implementations, the hydraulically fracture stimulation process may include include fracturing (e.g., with acid and/or sand, with water, hydrocarbon or gases), and/or pumping below a fracturing gradient (e.g., matrix acidized).

Figure 4:
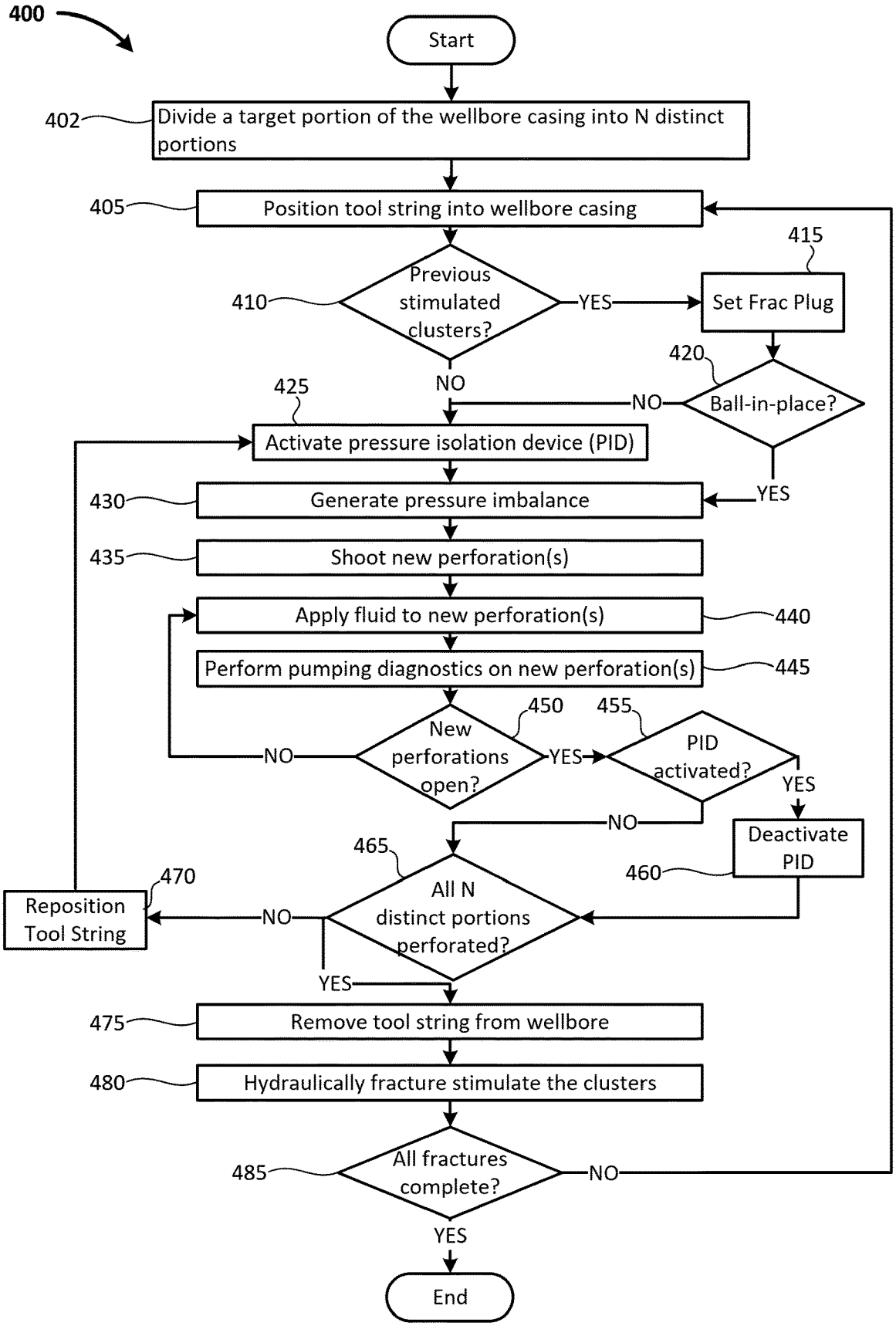
FIG. 4 depicts an exemplary method of selective overbalanced perforation and injection.

FIG. 4 depicts an exemplary method 400 of selective overbalanced perforation and injection. In the depicted method 400, a target portion of the wellbore casing is divided 402 into N distinct portions. Next, a perforating tool string (e.g., the OBBHA 130) is positioned 405 in a wellbore (e.g., the wellbore casing 105). If previous clusters of perforations were made in the casing and stimulated 410, then a frac plug is set 415. If the frac plug is not a ball-in-place plug (or other mechanism which fluidly seals a lower portion of the casing from an upper portion) 420, then a pressure isolation device (e.g., PID 150) is activated 425. If there are not previous stimulated perforation clusters 410 (e.g., in the current frac stage, in a first frac stage to isolate the current section from a toe of the well), then the PID is activated 425.

If there were previously stimulated clusters 410 and a ball-in-place frac plug (or other suitable sealing mechanism) was set 420, or after activation 425 of the PID, then a pressure imbalance is generated 430 at least in the section of the casing which is to be perforated. Pressure imbalance may, by way of example and not limitation, be over balance or underbalanced.

Accordingly, a target portion of casing for a next cluster (e.g., corresponding to one or more perforation guns) of perforations maybe advantageously fluidly isolated from downhole casing. For example, the target portion of casing may be selectively isolated from previously formed perforations. The previously formed may, perforations may, by way of example and not limitation, have been previously stimulated. In various embodiments the PID may be activated even if a frac plug was set and or previous perforations were not made. Accordingly, the target region may be advantageously isolated from a downhole region (e.g., to reduce time, stimulation fluid, and/or cost).

Once the pressure imbalance is generated 430, new perforations are shot 435 (e.g., by the perforation gun(s) 210). Stimulation fluid is applied 440 to the new perforations. The new perforations may thereby be selectively stimulated by the fluid and/or pressure imbalance by being isolated from downhole regions and or perforations by the PID.

In the depicted example, once the new perforations have been stimulated by applying fluid 440 and or pressure 430, pumping diagnostics are performed 445 on the new perforations. If the pumping diagnostics 445 demonstrate the perforations are not open 450, then steps 440 through 450 are repeated. Once the perforations are determined to be open 450 and if the PID was activated 455, then the PID is deactivated 460. In some implementations, by way of example and not limitation, steps 445 and/or 450 may be omitted.

In the depicted example, if the PID was not activated 455, or has been deactivated 460, and if all clusters are not yet perforated in the current stage (e.g., in a current frac stage) 465, then the perforating tool string is repositioned 470 and the steps 425 through 465 are repeated. Once the perforation clusters (e.g., all the perforation clusters to be made in the current stage 465) are made in the current stage 465, then the tool string is removed 475 from the wellbore. The (entire) wellbore may then be hydraulically fracture stimulated 480 through the perforations formed. In some implementations, by way of example and not limitation, steps 470 and/or repeating steps 425-465 may be omitted.

Once the just formed perforations are fracture stimulated, if all fracture stages are not complete 485, then steps 405 through 485 are repeated. Once all fracture stages are complete 485, then the process ends.

Figure 5:
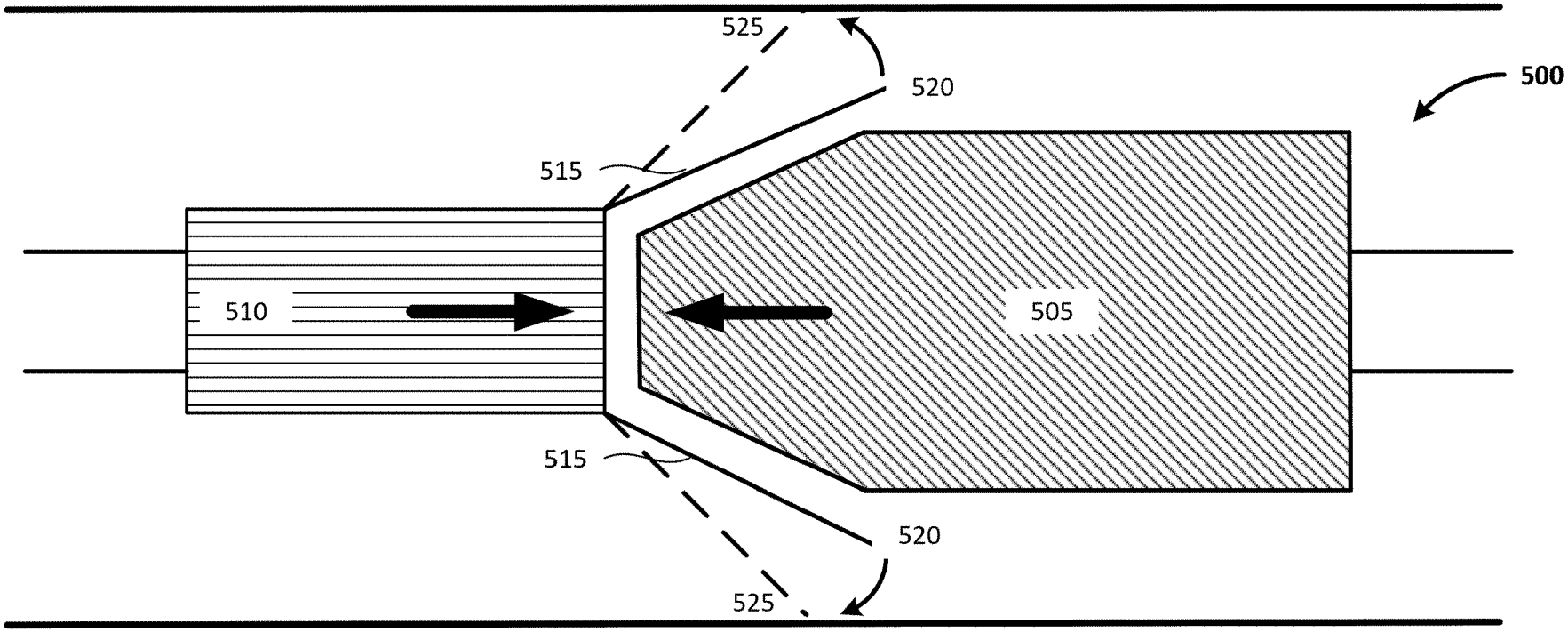
FIG. 5 depicts a first embodiment of an exemplary pressure isolation device (PID).

FIG. 5 depicts a first embodiment of an exemplary pressure isolation device (PID) 500. In this example, the PID 500 includes a receiving module 505 and a sealing surface module 510. The sealing surface module 510 includes sealing surfaces 515. When the PID 500 is deactivated, the sealing surfaces are at positions 520. In this example, when the PID is activated, the receiving module 505 and the sealing surface module 510 may both apply an opposite force (as shown by the big arrows) towards each other. In some implementations, the receiving module 505 may include a conical portion to receive the sealing surfaces 515. In some examples, the forces may drive the sealing surfaces 515 to make contact with an inside wall to create an at least partially pressure seal. For example, the sealing surfaces 515 are driven to sealing positions 525. In some examples, the force between the receiving module 505 and the sealing surface module 510 may be driven by electromagnetic forces. For example, the receiving module 505 and the sealing surface module 510 may include electromagnetic module that pull each other together when activated. In some implementations, the receiving module 505 and the sealing surface module 510 may include fluid hydraulic motors to generate the force.

Figure 6:
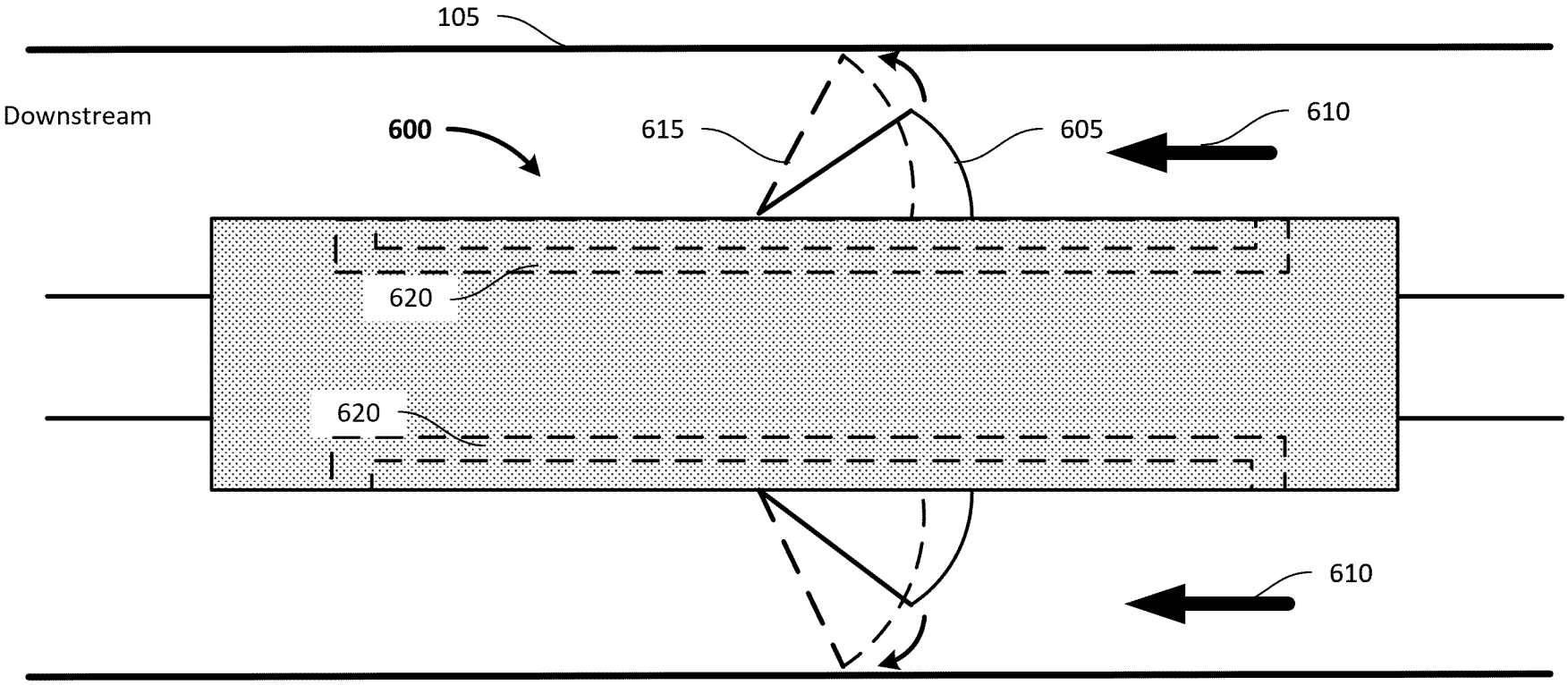
FIG. 6 depicts a second embodiment of an exemplary pressure isolation device (PID).

FIG. 6 depicts a second embodiment of an exemplary pressure isolation device (PID) 600. The PID 600 includes a flexible cone 605. For example, the flexible cone 605 may be an elastic diaphragm. In some implementations, the flexible cone 605 may expand when a fluid is, for example, pump in a direction as shown in arrows 610 as depicted. For example, the expanded flexible cone 615 may create at least partially a pressure seal to downstream of the wellbore casing 105. In some examples, when pumping stops, the flexible cone 605 may return to the original position, reopening the fluid communication to downstream. The PID 600 also includes a burst disk 620. In some implementations, the burst disk 620 may rupture by pressure or by electrical signal to allow an internal bypass when pulling the OBBHA 130 connected to the PID 600 out of the wellbore casing 105.

Figure 7:
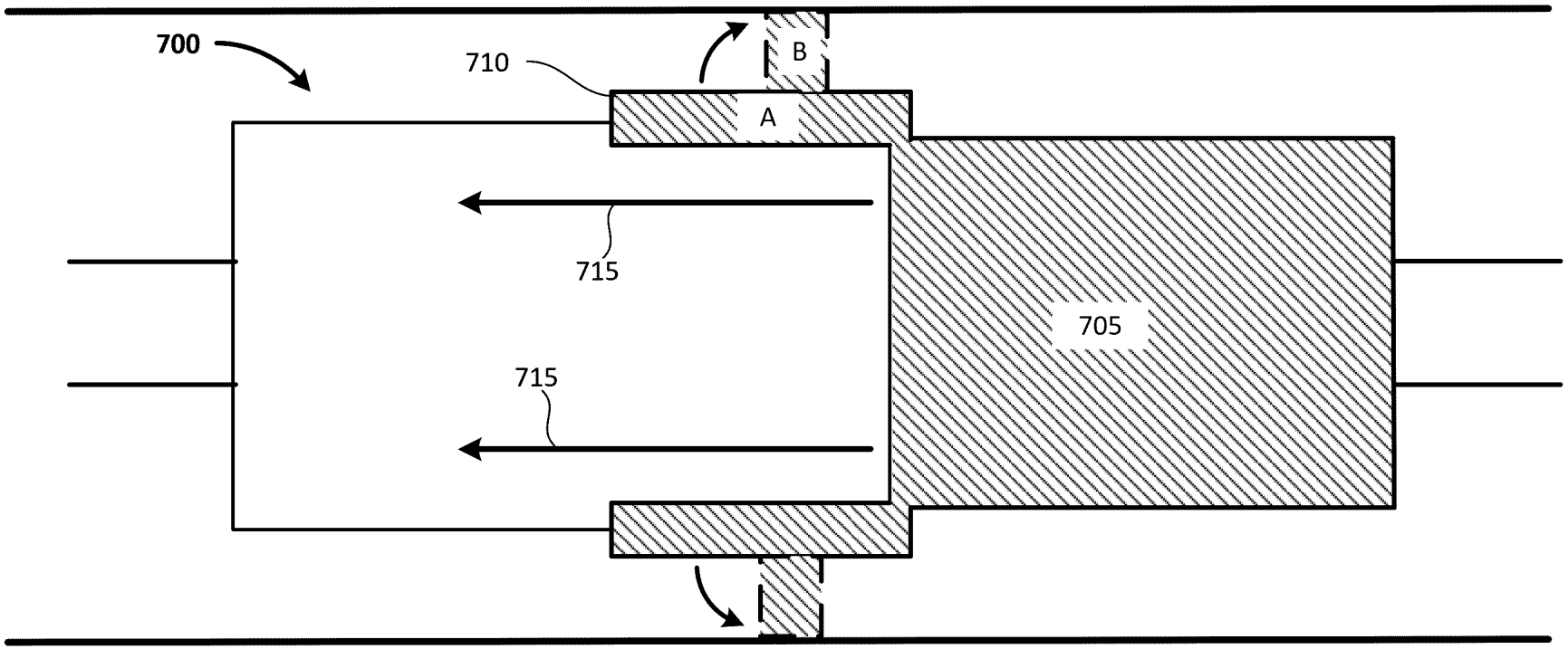
FIG. 7 depicts a third embodiment of an exemplary pressure isolation device (PID).

FIG. 7 depicts a third embodiment of an exemplary pressure isolation device (PID) 700. The PID 700 includes a sealing module 705 with a sealing surface 710. In a non-deployed mode, the sealing surface 710 is at a position A. In a deployed mode, a force 715 is applied in the direction of arrows, the sealing module 705 squishes the sealing surface 710 to position B against an inside wall of the wellbore casing 105. For example, the sealing surface 710 at the position B may create a pressure seal or a partial seal. When the force 715 is removed, the sealing surface 710 may return to the position A.

Figure 8:
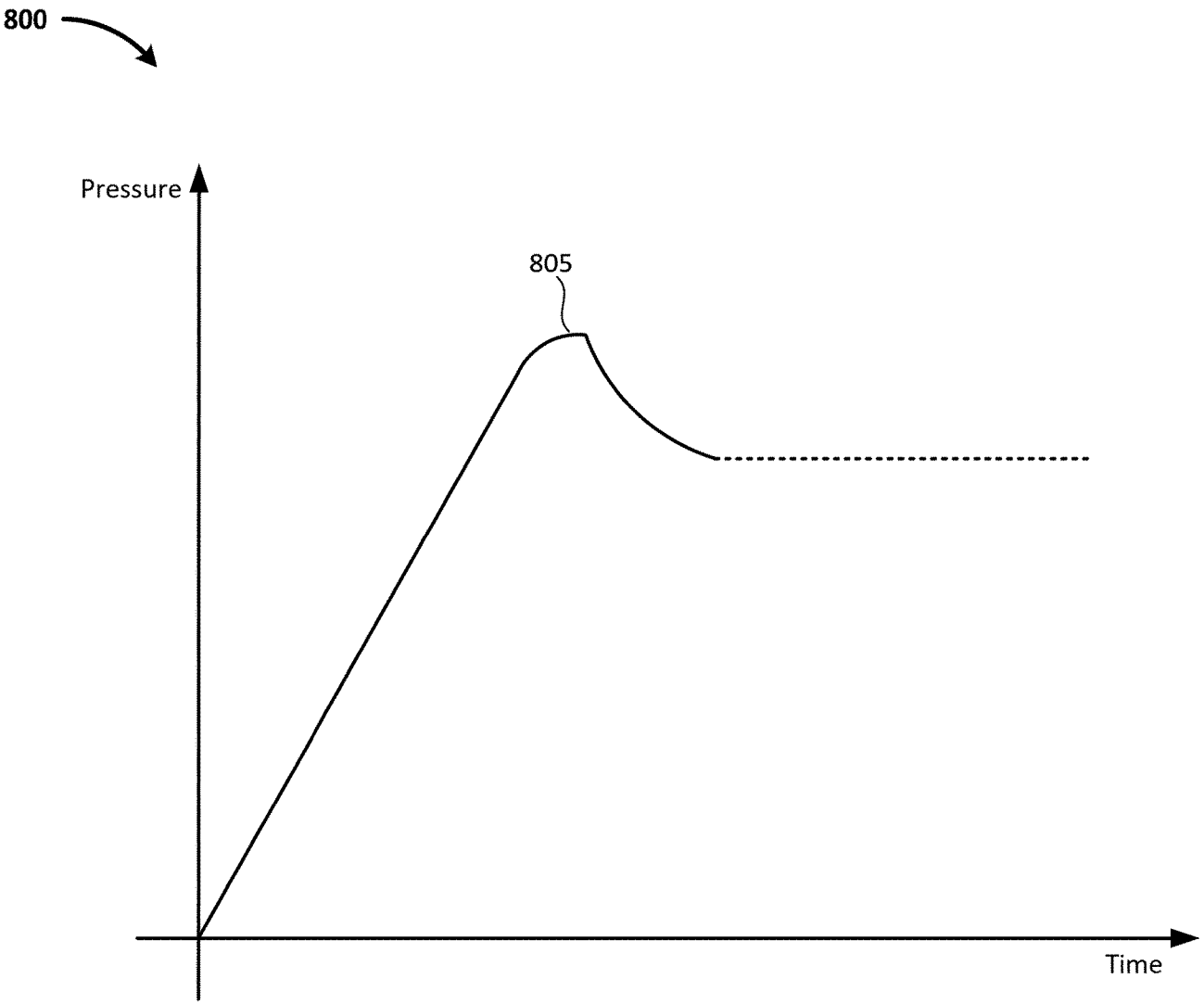
FIG. 8 is a diagram showing an exemplary pressure and time relationship during cluster skin-repairing operations.

FIG. 8 is a diagram showing an exemplary pressure and time relationship 800 during cluster skin-repairing operations. For example, after a cluster of perforations are created, pumping of the access-enhancing fluid may increase initially a pressure within the wellbore casing 105 over time. As shown in FIG. 8, the pressure may increase until a breakdown pressure is reached. After the breakdown pressure has been reached, the pressure decreases in this example. In some implementations, a pumping diagnostic module may use the pressure at various time after pumping detect whether a breakdown pressure 805 of the geological formation around the stimulating perforations is reached. Accordingly, in some implementations, environmental impact may be advantageously reduced in the fracture stimulation operations because the breakdown pressure 805 has been reached.

Although various embodiments have been described with reference to the figures, other embodiments are possible. In some implementations, the SOPI system may manipulate a wellbore casing pressure into overbalanced, balanced, underbalanced to reservoir pressure or to fracturing pressure. For example, by manipulating the pressure in the wellbore where perforations are being made, the SOPI system 100 allows for the breakdown and fracture pressure to be exceeded at the instant of creating the access to the reservoir.

Although an exemplary system has been described with reference to FIGS. 1A-1B, other implementations may be deployed in other industrial, scientific, medical, commercial, and/or residential applications. In some implementations, the method 400 may include fine tuning of limited entry technique. For example, the method 400 may measure each cluster pressure profile individually. In some implementations, the method 400 may include measuring anisotropy or rock properties within an interval that is hydraulically fracture stimulated.

In various embodiments, some bypass circuits implementations may be controlled in response to signals from analog or digital components, which may be discrete, integrated, or a combination of each. Some embodiments may include programmed, programmable devices, or some combination thereof (e.g., PLAs, PLDs, ASICs, microcontroller, microprocessor), and may include one or more data stores (e.g., cell, register, block, page) that provide single or multi-level digital data storage capability, and which may be volatile, non-volatile, or some combination thereof. Some control functions may be implemented in hardware, software, firmware, or a combination of any of them.

Computer program products may contain a set of instructions that, when executed by a processor device, cause the processor to perform prescribed functions. These functions may be performed in conjunction with controlled devices in operable communication with the processor. Computer program products, which may include software, may be stored in a data store tangibly embedded on a storage medium, such as an electronic, magnetic, or rotating storage device, and may be fixed or removable (e.g., hard disk, floppy disk, thumb drive, CD, DVD).

Although an example of a system, which may be portable, has been described with reference to the above figures, other implementations may be deployed in other processing applications, such as desktop and networked environments.

Temporary auxiliary energy inputs may be received, for example, from chargeable or single use batteries, which may enable use in portable or remote applications. Some embodiments may operate with other DC voltage sources, such as a 9V (nominal) batteries, for example. Alternating current (AC) inputs, which may be provided, for example from a 50/60 Hz power port, or from a portable electric generator, may be received via a rectifier and appropriate scaling. Provision for AC (e.g., sine wave, square wave, triangular wave) inputs may include a line frequency transformer to provide voltage step-up, voltage step-down, and/or isolation.

Although particular features of an architecture have been described, other features may be incorporated to improve performance. For example, caching (e.g., L1, L2, . . . ) techniques may be used. Random access memory may be included, for example, to provide scratch pad memory and or to load executable code or parameter information stored for use during runtime operations. Other hardware and software may be provided to perform operations, such as network or other communications using one or more protocols, wireless (e.g., infrared) communications, stored operational energy and power supplies (e.g., batteries), switching and/or linear power supply circuits, software maintenance (e.g., self-test, upgrades), and the like. One or more communication interfaces may be provided in support of data storage and related operations.

Some systems may be implemented as a computer system that can be used with various implementations. For example, various implementations may include digital circuitry, analog circuitry, computer hardware, firmware, software, or combinations thereof. Apparatus can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Various embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, which may include a single processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits).

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. Various embodiments may be implemented in a computer system that includes a graphical user interface and/or an Internet browser. To provide for interaction with a user, some implementations may be implemented on a computer having a display device, such as a CRT (cathode ray tube) or LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, the computers and networks forming the Internet, or some combination thereof. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Firewire, ATA/IDE, RS-232, RS-422, RS-485, 802.11 a/b/g, Wi-Fi, Ethernet, IrDA, FDDI (fiber distributed data interface), token-ring networks, multiplexing techniques based on frequency, time, or code division, or some combination thereof. Some implementations may optionally incorporate features such as error checking and correction (ECC) for data integrity, or security measures, such as encryption (e.g., WEP) and password protection.

In various embodiments, the computer system may include Internet of Things (IoT) devices. IoT devices may include objects embedded with electronics, software, sensors, actuators, and network connectivity which enable these objects to collect and exchange data. IoT devices may be in-use with wired or wireless devices by sending data through an interface to another device. IoT devices may collect useful data and then autonomously flow the data between other devices.

Various examples of modules may be implemented using circuitry, including various electronic hardware. By way of example and not limitation, the hardware may include transistors, resistors, capacitors, switches, integrated circuits, other modules, or some combination thereof. In various examples, the modules may include analog logic, digital logic, discrete components, traces and/or memory circuits fabricated on a silicon substrate including various integrated circuits (e.g., FPGAs, ASICs), or some combination thereof. In some embodiments, the module(s) may involve execution of preprogrammed instructions, software executed by a processor, or some combination thereof. For example, various modules may involve both hardware and software.

In an illustrative example, a wellbore completion method within a wellbore casing may divide a target portion of the wellbore casing into N distinct portions along a length of the wellbore casing. The method may insert a wellbore completion tool into the wellbore casing. The wellbore completion method may set a plug at a downstream boundary of the target portion such that the target portion may be fluidly isolated from other downstream clusters in the wellbore casing.

For each of the N distinct portions, the method may, from a most downstream portion within the target portion, select the most downstream portion without perforation. The wellbore completion method may position the wellbore completion tool at the selected portion. The wellbore completion method may perform isolation operations to releasably fluidly isolate the selected portion from downstream such that the selected portion is isolated from substantially all downstream perforation clusters. The method may include generate a cluster of perforations at the fluidly isolated selected portion. The wellbore completion method may perform cluster skin-repairing operations by pumping externally to the wellbore completion tool, from upstream, a non-particulate skin-repairing fluid at a pumping pressure such that a breakdown pressure of a geological formation surrounding the wellbore casing at the cluster of perforations is exceeded. Upon the breakdown pressure being exceeded, the method may include reestablishing fluid communication between the selected portion and the downstream perforation clusters. After clusters of perforations have been formed at substantially all N distinctive portions, the wellbore completion method may include removing the wellbore completion tool from the wellbore. The wellbore completion method may include perform completion operations to complete opening of the geological formations through the generated clusters of perforations.

The completion operations may further include pump a fracturing fluid at a pressure below the breakdown pressure.

The cluster skin-repairing operations may include detect a drop in wellbore pressure while the pumping pressure is maintaining or increasing. The operations may determine whether the breakdown pressure is exceeded when the drop exceeds a predetermined threshold.

After the isolation operations, the wellbore completion method may include selectively pressurize the fluidly isolated selected portion.

The isolation operations may include pumping a fluid downstream against an isolation diaphragm such that the isolation diaphragm is releasably coupled to a wall of the wellbore casing.

The isolation operations may include applying a force from a first sealing module to a sealing surface such that the sealing surface is releasably coupled to a wall of the wellbore casing.

The isolation operations may include applying an opposite force from sealing module against a receiving module such that, a sealing surface is pressingly attached to a wall of the wellbore casing. The applied force may be electromagnetic force. The applied force may be at least partially generated by fluid hydraulics.

In an illustrative example, a wellbore completion method within a wellbore casing may divide a target portion of the wellbore casing into N distinct portions along a length of the wellbore casing. The wellbore completion method may include insert a wellbore completion tool into the wellbore casing. The wellbore completion method may include, from a most downstream portion within the target portion, perform perforation operations for each of the N distinct portions. The method may include select the most downstream portion without perforation. The method may include position the wellbore completion tool at the selected portion. The wellbore completion method may include perform isolation operations to releasably fluidly isolate the selected portion from downstream such that the selected portion is isolated from substantially all downstream perforation clusters.

The wellbore completion method may include generate a cluster of perforations at the fluidly isolated selected portion. The method may include perform a cluster skin-repairing operations by pumping, from upstream, a non-particulate skin-repairing fluid at a pumping pressure such that a breakdown pressure of a geological formation surrounding the wellbore casing at the cluster of perforations is exceeded. Upon the breakdown pressure being exceeded, the wellbore completion method may include reestablish fluid communication between the selected portion and the downstream perforation clusters, After clusters of perforations have been formed at substantially all N distinctive portions, the wellbore completion method may include remove the wellbore completion tool from the wellbore. The method may include perform completion operations to complete opening of the geological formations through the generated clusters of perforations.

Before performing the perforation operations, the wellbore completion method may include set a plug at a downstream boundary of the target portion such that the target portion is fluidly isolated from other downstream clusters in the wellbore.

The completion operations may include pumping a stimulation fluid at a pressure below the breakdown pressure. The pumping pressure may be provided external to the wellbore completion tool.

The cluster skin-repairing operations may include detect a drop in wellbore pressure while the pumping pressure is maintaining or increasing. The cluster skin-repairing operations may include determine that the breakdown pressure is exceeded as a function of the drop exceeding a predetermined threshold.

After the isolation operations, the wellbore completion method may include selectively pressurize the fluidly isolated selected portion.

The isolation operations may include pumping a fluid downstream against an isolation diaphragm such that the isolation diaphragm may be releasably coupled to a wall of the wellbore casing. The isolation operations may include apply a force from a first sealing module to a sealing surface such that the sealing surface is releasably coupled to a wall of the wellbore casing. The isolation operations may include apply an opposite force from a sealing module against a receiving module such that a sealing surface is pressingly attached to a wall of the wellbore casing. The applied force may include electromagnetic force. The applied force may be at least partially generated by fluid hydraulics.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A wellbore completion method within a wellbore casing, comprising:

divide a target portion of the wellbore casing into N distinct portions along a length of the wellbore casing, insert a wellbore completion tool into the wellbore casing, set a plug at a downstream boundary of the target portion such that the target portion is fluidly isolated from other downstream clusters in the wellbore casing, from a most downstream portion within the target portion, and for each of the N distinct portions, select the most downstream portion without perforation, position the wellbore completion tool at the selected portion, perform isolation operations to releasably fluidly isolate the selected portion from downstream such that, the selected portion is isolated from substantially all downstream perforation clusters, generate a cluster of perforations at the fluidly isolated selected portion, perform a cluster skin-repairing operation by pumping externally to the wellbore completion tool, from upstream, a non-particulate skin-repairing fluid at a pumping pressure such that a breakdown pressure of a geological formation surrounding the wellbore casing at the cluster of perforations is exceeded, and upon the breakdown pressure is exceeded, reestablish fluid communication between the selected portion and the downstream perforation clusters, after clusters of perforations have been formed at substantially all N distinctive portions, remove the wellbore completion tool from the wellbore, and perform completion operations to complete opening of the geological formations through the generated clusters of perforations.

2. The wellbore completion method of claim 1, wherein the completion operations further comprising pumping a fracturing fluid at a pressure below the breakdown pressure.

3. The wellbore completion method of claim 1, wherein the cluster skin-repairing operation further comprises, detect a drop in wellbore pressure while the pumping pressure is maintaining or increasing, and determine that the breakdown pressure is exceeded when the drop exceeds a predetermined threshold.

4. The wellbore completion method of claim 1, further comprising:

after the isolation operations, selectively pressurize the fluidly isolated selected portion.

5. The wellbore completion method of claim 1, wherein the isolation operations comprise:

pumping a fluid downstream against an isolation diaphragm such that the isolation diaphragm is releasably coupled to a wall of the wellbore casing.

6. The wellbore completion method of claim 1, wherein the isolation operations comprise:

apply a force from a first sealing module to a sealing surface such that the sealing surface is releasably coupled to a wall of the wellbore casing.

7. The wellbore completion method of claim 6, wherein the applied force comprises electromagnetic force.

8. The wellbore completion method of claim 6 wherein the applied force is at least partially generated by fluid hydraulics.

9. The wellbore completion method of claim 1, wherein the isolation operations comprise:

apply an opposite force from sealing module against a receiving module such that, a sealing surface is pressingly attached to a wall of the wellbore casing.

10. A wellbore completion method within a wellbore casing, comprising:

divide a target portion of the wellbore casing into N distinct portions along a length of the wellbore casing, insert a wellbore completion tool into the wellbore casing, from a most downstream portion within the target portion, perform perforation operations for each of the N distinct portions, select the most downstream portion without perforation, position the wellbore completion tool at the selected portion, perform isolation operations to releasably fluidly isolate the selected portion from downstream such that, the selected portion is isolated from substantially all downstream perforation clusters, generate a cluster of perforations at the fluidly isolated selected portion, perform a cluster skin-repairing operation by pumping, from upstream, a non-particulate skin-repairing fluid at a pumping pressure such that a breakdown pressure of a geological formation surrounding the wellbore casing at the cluster of perforations is exceeded, and upon the breakdown pressure is exceeded, reestablish fluid communication between the selected portion and the downstream perforation clusters, after clusters of perforations have been formed at substantially all N distinctive portions, remove the wellbore completion tool from the wellbore, and perform completion operations to complete opening of the geological formations through the generated clusters of perforations.

11. The wellbore completion method of claim 10, further comprising:

before performing the perforation operations, set a plug at a downstream boundary of the target portion such that the target portion is fluidly isolated from other downstream clusters in the wellbore.

12. The wellbore completion method of claim 10, wherein the completion operations further comprise pumping a stimulation fluid at a pressure below the breakdown pressure.

13. The wellbore completion method of claim 10, wherein the pumping pressure is provided external to the wellbore completion tool.

14. The wellbore completion method of claim 10, wherein the cluster skin-repairing operation further comprises:

detect a drop in wellbore pressure while the pumping pressure is maintaining or increasing, and determine that the breakdown pressure is exceeded as a function of the drop exceeding a predetermined threshold.

15. The wellbore completion method of claim 10, further comprising:

after the isolation operations, selectively pressurize the fluidly isolated selected portion.

16. The wellbore completion method of claim 10, wherein the isolation operations comprise:

pumping a fluid downstream against an isolation diaphragm such that the isolation diaphragm is releasably coupled to a wall of the wellbore casing.

17. The wellbore completion method of claim 10, wherein the isolation operations comprise:

apply a force from a first sealing module to a sealing surface such that the sealing surface is releasably coupled to a wall of the wellbore casing.

18. The wellbore completion method of claim 17, wherein the applied force comprises electromagnetic force.

19. The wellbore completion method of claim 17, wherein the applied force is at least partially generated by fluid hydraulics.

20. The wellbore completion method of claim 10, wherein the isolation operations comprise:

apply an opposite force from a sealing module against a receiving module such that a sealing surface is pressingly attached to a wall of the wellbore casing.

* * * * *